United States Patent [19]

Fukuzawa et al.

[11] 4,335,329

[45] Jun. 15, 1982

[54] MASK SUPPORT FOR SHADOW MASK ASSEMBLY

[75] Inventors: Kenichi Fukuzawa, Mobara; Tetsuo Kumazawa, Dejimamura, both of Japan

[73] Assignee: Hitachi, Ltd., Tokyo, Japan

[21] Appl. No.: 147,962

[22] Filed: May 8, 1980

[30] Foreign Application Priority Data

May 18, 1979 [JP] Japan ..... 54-60438

[51] Int. Cl.[3] ..... H01J 29/07

[52] U.S. Cl. ..... 313/406; 313/407

[58] Field of Search ..... 313/404, 406, 407

[56] References Cited

U.S. PATENT DOCUMENTS 3,487,251 12/1969 Barten et al. ..... 313/406
3,524,971 8/1970 Schwartz et al. ..... 313/406
3,832,592 8/1974 Yamazaki ..... 313/404

FOREIGN PATENT DOCUMENTS 44-3546 2/1969 Japan .
46-21499 6/1971 Japan .

*Primary Examiner*—Palmer C. Demeo
*Attorney, Agent, or Firm*—Craig and Antonelli

[57] ABSTRACT

A mask support including a multiplicity of retainers is disclosed which supports a shadow mask assembly consisting of a shadow mask disposed in front of a fluorescent screen formed on the internal panel surface of a color picture tube and of a frame to hold the shadow mask. Each of the retainers comprises a spring member secured to the side wall of the frame and a rigid support member for supporting most weight of the shadow mask assembly, which rigid support member is attached to the spring member and engages a fixed member fixed on an internal surface of the picture tube. The spring member provides an action which causes the support member to be displaced towards the internal surface of the color picture tube so that the support member and the fixed member are firmly engaged.

8 Claims, 13 Drawing Figures

MASK SUPPORT FOR SHADOW MASK ASSEMBLY

This invention relates to a mask support including a multiplicity of retainers for supporting at a predetermined location in front of a fluorescent screen of a color picture tube a shadow mask assembly disposed inside the panel portion of the color picture tube.

The prior art and the present invention and the advantages of the latter will be described in detail with reference to the accompanying drawings, in which.

Figure 1:
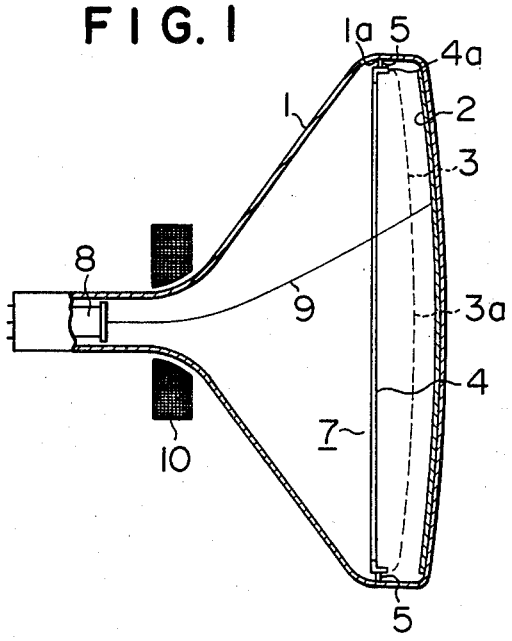
FIG. 1 is a cross sectional view of a color picture tube, showing schematically its structure.

Referring now to FIG. 1, a color picture tube 1 comprises a fluorescent screen 2 having a multiplicity of phosphor elements for three primary colors formed on the internal surface of the panel of the tube 1 and a shadow mask 3 disposed in front of the fluorescent screen 2 and in a plane substantially perpendicular to the tube axis of the tube 1. The shadow mask 3 is held by a frame 4. The frame 4 has side walls 4*a* which are arranged in a substantially parallel relationship with the tube axis and in opposition to portions of internal tube surface 1*a* which is substantially parallel with the tube axis. On the side walls 4*a* mounted are retainers 5. The retainers 5 include pins 6 (FIGS. 4B and 5B) fixed to the internal tube surface 1*a*. A shadow mask assembly 7 consisting of the shadow mask 3 and the frame 4 is supported or retained at a pedetermined position in front of the flourescent screen 2 by means of a mask support composed of these retainers 5.

Within a neck portion of the color picture tube, an electron gun is disposed which emits three electron beams in correspondence with three primary colors. In FIG. 1 only one such electron beam 9 is shown for the sake of simplicity. The electron beams are deflected by means of a deflection coil 10 and passed through a multiplicity of apertures 3*a* provided in the shadow mask 3, then impinge on the corresponding phosphor elements in the screen 3 to reproduce a picture thereon. The electron beams, which do not pass through the apertures 3*a*, impinge on the shadow mask 3 or the frame 4, thereby raising the temperature of the shadow mask assembly 7, whence the assembly undergoes thermal expansion. The thermal expansion of the shadow mask assembly will result in a change in the positional relationship between the shadow mask apertures 3*a* and the phosphor elements with respect to the electron beam, which change will cause the electron beams passing through the apertures 3*a* to fail to reach the corresponding phosphor elements correctly and introduce undesirable effects such as degradation in color purity of a picture to be reproduced.

Figure 2:
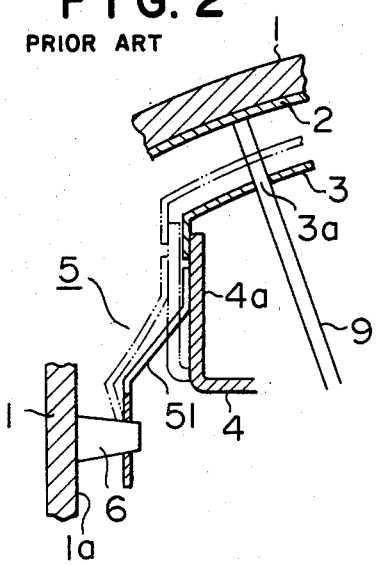
FIG. 2 PRIOR ART
FIG. 2 illustrates a conventional retainer of a mask support.

In order to minimize such a change in the positional relationship and to attain a better correspondence between the electron beam spot on the screen 2 and the corresponding phosphor element, in the prior art, the retainer 5 of the frame support uses a spring 51 made of a resilient thin plate as shown in FIG. 2, so that the spring partly converts such a thermally induced displacement of the shadow mask, perpendicular to the tube axis, into a displacement along the tube axis, i.e. perpendicular to the fluorescent screen. As shown in FIG. 2, the retainer 5 has the spring 51 which is made of an elongated and angled leaf spring, and one end of which is secured, for example by welding, to the side wall 4*a* of the frame 4, while the other end thereof engages with the pin 6 provided on the internal surface 1*a* of the color picture tube. As the shadow mask assembly 7 is displaced in the direction substantially parallel to the fluorescent screen 2 as a result of its thermal expansion, the spring 51 is displaced to a position indicated by a phantom line to partially convert the displacement along the fluorescent screen 2 into a displacement in the direction perpendicular to the fluorescent screen 2 so as to compensate the thermal expansion of the shadow mask, thereby suppressing the change in the relative positions of the apertures 3*a* and the phosphor elements on the fluorescent screen 2, with respect to the electron beam 9.

Figure 3:
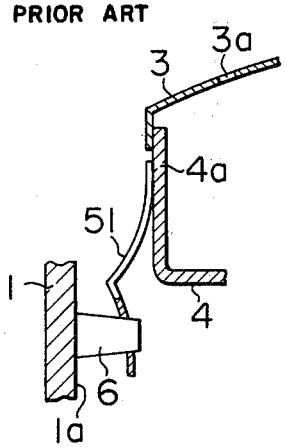
FIG. 3 PRIOR ART
FIG. 3 is a diagram for explaining a disadvantage of the conventional retainer shown in FIG. 2.

However, since the spring 51 is made of an elastic material, it is not only displaced as shown in FIG. 2 but also deformed as shown in FIG. 3 as the shadow mask assembly 7 thermally expands, so that the displacement of the shadow mask assembly 7 in the direction parallel with the fluorescent screen is increased. As a result, the amount of the displacement converted from the parallel to the perpendicular direction with respect to the fluorescent screen becomes too small to attain required compensation for the thermal expansion of the shadow mask assembly. To obtain sufficient compensation for the thermal expansion, it is necessary for example, to increase the thickness of the spring 51 so as to prevent such a deformation as shown in FIG. 3.

On the other hand, the shadow mask assembly 7 must be removable from its mounting position on the internal surface of the color picture tube panel during the process of fluorescent screen formation. Thus, the spring force of the retainer 5 must be such that the shadow mask assembly can be easily removed and remounted accurately back to its correct mounting position. Moreover, in order to retain the shadow mask assembly 7 at its correct position, the spring force must be of sufficient strength to support the weight of the shadow mask assembly.

However, as the spring force of the retainer 5 is increased to ensure accurate remounting and better retaining of the shadow mask assembly and to provide favorable compensation for the thermal expansion thereof as mentioned above, the removal and remounting workability is lowered. Conversely, the removal and remounting workability can be increased by decreasing the spring force of the retainer 5, only at the expense of remounting accuracy, retaining ability, and compensation for thermal expansion.

There have been proposed various kinds of supports for the shadow mask assembly as disclosed, for example in U.S. Pat. No. 3,832,592, and Japanese Patent Publications No. 3546/69 and No. 21499/71. The proposed supports, however, have the above disadvantages.

An object of this invention is to provide a support for the shadow mask assembly, which is exceedingly effective in compensation for thermal expansion of the assembly, ability of retaining and accuracy of remounting the assembly, and workability of removing and remounting the assembly.

Figure 4A:
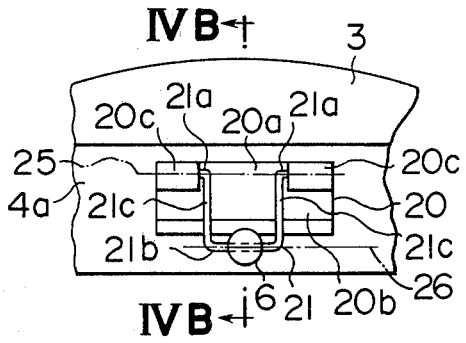
FIGS. 4A and 4B are a front view and a cross sectional view taken along the line IVB—IVB of the front view, respectively, of a first embodiment of a retainer according to the invention.
Figure 4B:
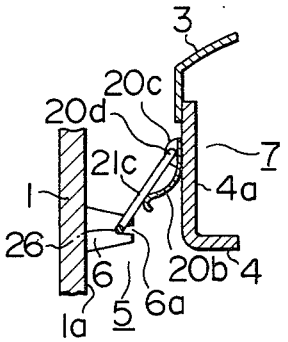

The invention will now be described by way of example with reference to the drawings. FIGS. 4A and 4B illustrate an embodiment of a retainer of a mask support according to the invention. The retainer 5 includes a spring member 20, a rigid U-shaped metallic support member 21, and the pin 6 secured on the internal surface 1*a* of the color picture tube 1. The spring member 20 comprises an anchor portion 20*a* which is secured by, for example, welding on the side wall 4*a* of the frame 4, and a leaf spring portion 20*b* extending from the anchor portion 20*a* as shown in the figure. A tip of the leaf spring portion 20*b* is in contact with the metallic support member 21 as shown in the figure. The anchor portion 20*a* has protrusion forming lugs 20*c*. Each lug 20*c* has a hole 20*d* which extends in a plane perpendicular to the tube axis and in parallel with the surface of the frame side wall 4*a* onto which the spring member 20 is mounted. The pin 6 has a groove 6*a* formed on its top, which groove extends in the same direction as the extending direction of the holes 20*d*. The metallic support member 21 has portions 21*a* to be inserted into the holes 20*d* of the lugs 20*c*, a portion 21*b* to be inserted into the groove 6*a*, and portions 21*c* connecting the portions 21*a* and 21*b*. The spring portion 20*b* of the spring member 20 provides a pivotal force about a fixed axis 25 which is defined practically by the holes 20*d*, the pivotal force acting upon the metallic support member 21 to rotate it about the fixed axis 25 and to displace it towards the internal surface 1*a* of the color picture tube 1, thereby ensuring the engagement of the portion 21*b* of the metallic support member 21 with the groove 6*a*.

As the shadow mask assembly 7 is thermally expanded and displaced in the direction parallel to the fluorescent screen 2, the metallic support member 21 pivots against the rotational force of the spring portion 21*b* about the axis 25 and a fixed axis 26 defined by the groove 6*a*. Due to this pivotal motion of the metallic support member 21, a part of the displacement of the shadow mask assembly in the direction parallel to the fluorescent screen 2 is converted to a displacement perpendicular to the fluorescent screen 2. Since in this case the metallic support member 21 is rigid, a shortage of the converted displacement described in connection with FIG. 3 does not take place, so that a favorable compensation for the thermal expansion is attained. Furthermore, the metallic support member 21 has sufficient rigidity to support the heavy shadow mask assembly and to provide good reproducibility in positioning the shadow mask removed. Moreover, since most of the weight of the shadow mask assembly 7 is supported by the metallic support member 21 and hence only a minor portion of the weight is applied to the spring portion 20*b*, moderate strength of the spring force thereof suffices for the support, so that the shadow mask assembly can be easily removed or remounted.

Figure 5A:
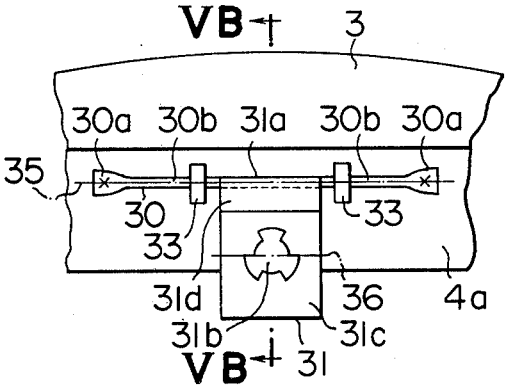
FIGS. 5A and 5B are a front view and a cross sectional view taken along the line VB—VB of the front view, respectively, of a second embodiment of a retainer according to the invention.
Figure 5B:
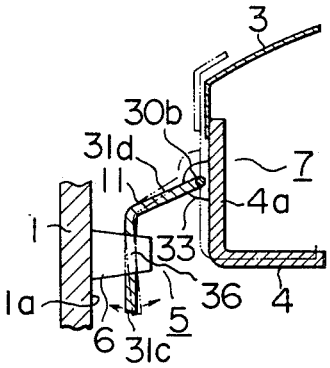

FIGS. 5A and 5B show another embodiment of a retainer according to the invention. In this embodiment, the retainer 5 includes a spring member 30 fixed on the side wall 4*a* of the frame 4, a support member 31 made of a metallic rigid plate, and the pin 6 secured on the internal surface 1*a* of the color picture tube. The pin 6 has a round cross section and is tapered towards its top end as shown in FIG. 5B. The spring member 30, made in the form of a bar, lies in a plane perpendicular to the tube axis and extends in parallel with the surface of the frame side wall on which the spring member 30 is mounted. The spring member 30 has at both ends thereof flat anchor portions 30*a* to be fixed to the frame side wall 4*a*, and an intermediate portion 30*b* extending between the anchor portions 30*a*. The intermediate portion 30*b* has been twisted with respect to the anchor portions 30*a* so as to provide a spring force or a pivotal force about a fixed axis 35 defined by the anchor portions 30*a* and passing though the intermediate portion 30*b*. Members 33 provided with holes for receiving the intermediate portion 30*b* therethrough provide reliable support for the intermediate portion 30*b*. The metallic support member 31 comprises a portion 31*a* which is secured by, for example, welding to the intermediate portion 30*b*, a portion 31*c* having a bore 31*b* which fits the pin 6, and a portion 31*d* connecting the portions 31*a* and 31*c*. The pivotal force of the intermediate portion 30*b* of the spring member 30 cause the metallic support member 31 fixed on the intermediate portion 30*b* to rotate about the fixed axis 35 and to move towards the internal surface 1*a* of the color picture tube, thereby ensuring the engagement of the pin 6 with the bore 31*b* of the metallic support member 31.

As the shadow mask assembly 7 is thermally expanded and a displacement of the shadow mask assembly parallel to the fluorescent screen 2 takes place, the metallic support member 31 is pivoted about the fixed axis 35 against the pivotal force of the intermediate portion 30*b*. This pivotal displacement alters the engaging conditions of the pin 6 in the bore 31*b* of the metallic support member 31 in such a manner that the portion 31*c* of the metallic support member 31 is pivoted about an axis 36 defined by the engagement between the bore 31*b* and the pin 6. Due to this pivotal motion of the metallic support member 31, a part of the displacement of the shadow mask assembly in the direction parallel to the fluorescent screen 2 is converted into a displacement perpendicular to the fluorescent screen 2. The phantom lines in FIG. 5B illustrate a position of the shadow mask assembly undergoing a thermal expansion.

Since also in this embodiment the metallic support member 31 is a rigid body rotatable about the axes 35 and 36, and supports most of the weight of the shadow mask assembly 7, similar effects as described regarding the foregoing embodiment can be obtained.

FIGS. 6A, 6B, 7A, 7B, 8, and 9 show further embodiments according to the invention, in which those members which are identical with or correspond to the members of FIGS. 5A and 5B, are indicated by the same number as in FIGS. 5A and 5B. The embodiment of FIGS. 6A and 6B differs from the embodiment of FIGS. 5A and 5B in that the spring member 30 is made of a resilient plate with the intermediate portion 30*b* thereof having protrusions 30*d* and a valley 30*c* therebetween. The protrusions 30*d* are formed by creasing the plate in its longitudinal direction. This intermediate portion 30*b* is, similarly to the embodiment of FIGS. 5A and 5B, twisted relative to its anchor portions 30*a* so that a torsional force thereof provides a pivotal spring force about the fixed axis 35 of the intermediate portion defined by the anchor portions 30*a*. The fixed portion 31*a* of the metallic support member 31 is fixed by, for example, welding to one of the two surfaces forming the valley 30*c*. In this embodiment, fixing the portion 31*a* to the intermediate portion 30*b* is easy and ensured. It will be understood that the intermediate portion 30*b* in this embodiment is different in shape from but similar in function as a torsional spring to that in the embodiment of FIGS. 5A and 5B, and hence this embodiment can attain the same effect as the previous embodiment.

Figure 6A:
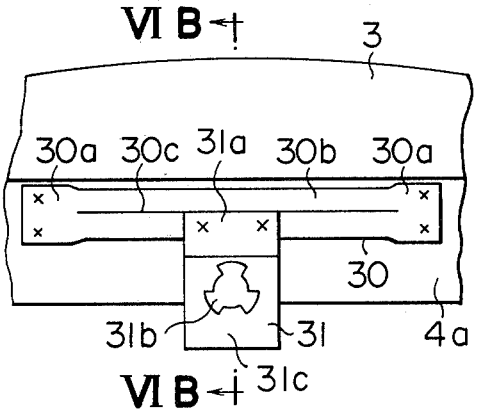
FIGS. 6A and 6B are a front view and a cross sectional view taken along the line VIB—VIB of the front view, respectively, of a third embodiment of a retainer according to the invention.
Figure 6B:
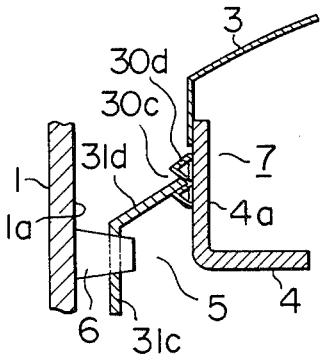
Figure 7A:
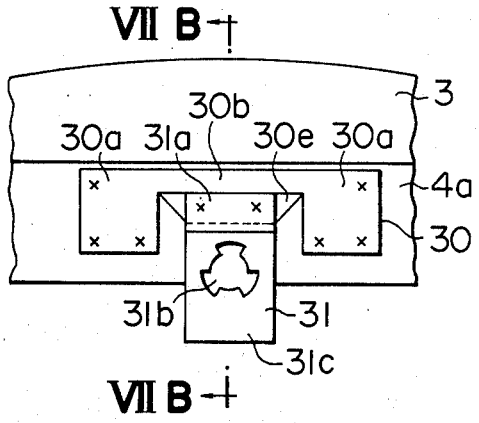
FIGS. 7A and 7B are a front view and a cross sectional view taken along the line VIIB—VIIB of the front view, respectively, of a fourth embodiment of a retainer according to the invention.
Figure 7B:
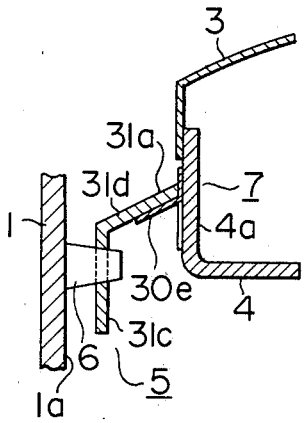

In the embodiment shown in FIGS. 7A and 7B, the intermediate portion 30*b* is the same as that in the embodiment of FIGS. 6A and 6B except that it is made of a flat plate partially folded towards the internal surface 1*a* of the color picture tube 1 to provide an angled plate portion 30*e*. The fixed portion 31*a* of the metallic support member 31 is fixed to this angled plate portion 30*e* by, for example, welding. Thus, fixing the portion 31*a* can be effected easily also in this embodiment. It is of course understood that the intermediate portion 30*b* is also subjected to a torsional force as described above.

Figure 8:
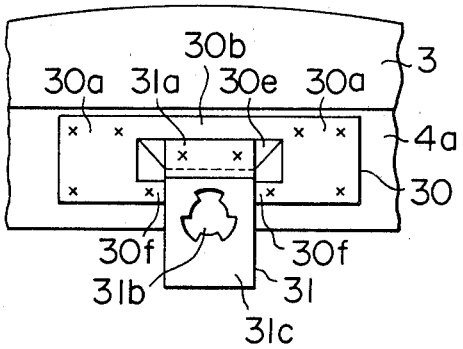
FIG. 8 is a front view of a fifth embodiment of a retainer according to the invention.

The embodiment of FIG. 8 is the same as the embodiment of FIGS. 7A and 7B except that the spring member 30 has a further plate portion 30*f* formed integrally with the anchor portions 30*a* and fixed to the side wall 4*a*. Since the intermediate portion 30*b* is twisted as before, it may be difficult to weld desirably the anchor portions 30*a* formed integrally with the intermediate portion 30*b* onto the side wall 4*a* of the frame 4. The plate portion 30*f* serves to eliminate such a difficulty. It will easily be understood that the embodiment of FIGS. 6A and 6B may be provided with a similar plate portion to the further plate portion 30*f* for attaining the same effect as described above.

Figure 9:
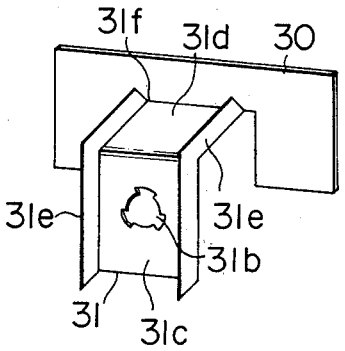
FIG. 9 is a perspective view of a sixth embodiment of a retainer according to the invention.

In the embodiment of FIG. 9, the spring member 30 and the metallic support member 31 are integrally formed of a resilient plate folded in a form as shown, and the metallic support member 31 has portions 31*e* folded along its side edges substantially at a right angle to the portions 31*c* and 31*d* to impart rigidity to the metallic support member 31. A bent portion 31*f* of this embodiment corresponds to the fixed portion 31*a* of the preceeding embodiments. The metallic support member 31 of this embodiment does not require welding thereof to the spring member 30.

What we claim is:

1. A support arrangement including a multiplicity of retainers for supporting a shadow mask assembly at predetermined positions inside the tube envelope of a color picture tube, said shadow mask assembly consisting of a shadow mask disposed in facing relationship to a fluorescent screen of the tube and in a plane perpendicular to the axis of the tube envelope and a frame having side walls facing internal surfaces of the tube envelope which are substantially parallel to said tube axis for holding said shadow mask, each of said retainers comprising:

a spring member secured on the side wall of said frame, having a fixed axis extending in a predetermined direction parallel to said side wall surface and in a plane perpendicular to said tube axis, and having a portion biased to provide a pivotal force about said fixed axis;

a fixed member securely provided on the internal surface of said tube envelope; and a rigid member with one end thereof being attached to said spring member and another end thereof engaging said fixed member, said rigid member being pivotally displaceable towards said internal surface of said tube envelope about said fixed axis by means of said pivotal force.

2. A support according to claim 1, wherein said spring member comprises an elongated member extending in said predetermined direction, said elongated member having two ends both secured on said side wall of said frame, and an intermediate portion extending between said two ends, said intermediate portion being disposed along said fixed axis defined by said secured ends and being twisted with respect to said fixed ends so as to provide said pivotal force about said fixed axis.

3. A support according to claim 2, wherein said fixed member comprises a pin member; said rigid member comprises a first portion secured to said intermediate portion, a second portion having a bore into which said pin member is inserted, and a third portion interconnecting said first and second portions.

4. A support according to claim 3, wherein said rigid member is integrally formed with said intermediate portion of said spring member.

5. A support including a multiplicity of retainers for supporting at a predetermined position inside a color picture tube a shadow mask assembly consisting of a shadow mask disposed facing a fluorescent screen of the tube and in a plane perpendicular to an axis of the tube and of a frame having side walls facing internal surfaces of the tube substantially parallel to said tube axis and holding said shadow mask, each of said retainers comprising:

a spring member secured on the side wall of said frame, having a fixed axis extending in a predetermined direction parallel to said side wall surface and in a plane perpendicular to said tube axis and having a pivotal force about said fixed axis;

a fixed member securely provided on the internal surface of said tube; and a rigid member with one end thereof being attached to said spring member and another end thereof engaging with said fixed member, said rigid member being pivotally displaceable towards the internal surface of said tube about said axis by means of said pivotal force;

wherein said spring member comprises a leaf spring with one end thereof being secured on the surface of said side wall of said frame and having a hole extending in said predetermined direction, and another end engageable with said rigid member; said fixed member comprises a pin member with a top end provided with a groove extending in said predetermined direction; and said rigid member comprises a first portion to be inserted into said hole, a second portion to be inserted into said groove, and a third portion interconnecting said first and second portions.

6. A support including a multiplicity of retainers for supporting at a predetermined position inside a color picture tube a shadow mask assembly consisting of a shadow mask disposed facing a fluorescent screen of the tube and in a plane perpendicular to an axis of the tube and of a frame having side walls facing internal surfaces of the tube substantially parallel to said tube axis and holding said shadow mask, each of said retainers comprising:

a spring member secured on the side wall of said frame, having a fixed axis extending in a predetermined direction parallel to said side wall surface and in a plane perpendicular to said tube axis and having a pivotal force about said fixed axis;

a fixed member securely provided on the internal surface of said tube; and a rigid member with one end thereof being attached to said spring member and another end thereof engaging with said fixed member, said rigid member being pivotally displaceable towards the internal surface of said tube about said axis by means of said pivotal force;

wherein said spring member comprises an elongated member extending in said predetermined direction, said elongated member having two ends both secured on said side wall of said frame, and an intermediate portion extending between said two ends, said intermediate portion having said fixed axis defined by said secured ends and having said pivotal force about said fixed axis;

wherein said fixed member comprises a pin member, said rigid member comprises a first portion secured to said intermediate portion, a second portion having a bore into which said pin member is inserted, and a third portion interconnecting said first and second portions;

wherein said intermediate portion has a protruding portion extending in said predetermined direction and having a plane to which said first portion of said rigid member is secured.

7. A support according to claim 6, wherein said spring member further comprises a portion formed integrally with said secured ends and secured on the side wall of said frame.

8. A support including a multiplicity of retainers for supporting at a predetermined position inside a color picture tube a shadow mask assembly consisting of a shadow mask disposed facing a fluorescent screen of the tube and in a plane perpendicular to an axis of the tube and of a frame having side walls facing internal surfaces of the tube substantially parallel to said tube axis and holding said shadow mask, each of said retainers comprising:

a spring member secured on the side wall of said frame, having a fixed axis extending in a predetermined direction parallel to said side wall surface and in a plane perpendicular to said tube axis and having a pivotal force about said fixed axis;

a fixed member securely provided on the internal surface of said tube; and a rigid member with one end thereof being attached to said spring member and another end therof engaging with said fixed member, said rigid member being pivotally displaceable towards the internal surface of said tube about said axis by means of said pivotal force;

wherein said spring member comprises an elongated member extending in said predetermined direction, said elongated member having two ends both secured on said side wall of said frame, and an intermediate portion extending between said two ends, said intermediate portion having said fixed axis defined by said secured ends and having said pivotal force about said fixed axis;

wherein said fixed member comprises a pin member, said rigid member comprises a first portion secured to said intermediate portion, a second portion having a bore into which said pin member is inserted, and a third portion interconnecting said first and second portions;

wherein said intermediate portion has a form of a flat plate and has an angled plate portion integrally formed therewith and extending towards the internal surface of said tube.

* * * * *